US011946152B2

(12) United States Patent
Leonhard et al.

(10) Patent No.: US 11,946,152 B2
(45) Date of Patent: Apr. 2, 2024

(54) METHOD AND SYSTEM FOR DEPOSITING A ZINC-NICKEL ALLOY ON A SUBSTRATE

(71) Applicant: Atotech Deutschland Gmbh & Co. KG, Berlin (DE)

(72) Inventors: Steven Leonhard, Berlin (DE); Thomas Freese, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 0 days.

(21) Appl. No.: 17/778,104

(22) PCT Filed: Dec. 18, 2020

(86) PCT No.: PCT/EP2020/086976

§ 371 (c)(1),
(2) Date: May 19, 2022

(87) PCT Pub. No.: WO2021/123129

PCT Pub. Date: Jun. 24, 2021

(65) Prior Publication Data

US 2022/0349080 A1 Nov. 3, 2022

(30) Foreign Application Priority Data

Dec. 20, 2019 (EP) ..... 19218655

(51) Int. Cl.
*C25D 21/08* (2006.01)
*C25D 3/22* (2006.01)
(Continued)

(52) U.S. Cl.
CPC ..... *C25D 3/22* (2013.01); *C25D 5/34* (2013.01)

(58) Field of Classification Search
CPC ..... C25D 3/562; C25D 3/565; C25D 21/08; C25D 21/16; C25D 21/18; C25D 21/20
(Continued)

(56) References Cited

U.S. PATENT DOCUMENTS

2004/0026255 A1* 2/2004 Kovarsky ..... C25D 21/18 205/291
2006/0254923 A1* 11/2006 Tran ..... C25D 3/565 205/245
(Continued)

FOREIGN PATENT DOCUMENTS

DE 10254952 A1 * 3/2004 ..... B01D 61/025
DE 202015002289 U1 5/2015
(Continued)

OTHER PUBLICATIONS

PCT/EP2020/086976; International Search Report and Written Opinion of the International Searching Authority dated Apr. 13, 2021.

*Primary Examiner* — Edna Wong
(74) *Attorney, Agent, or Firm* — Renner, Otto, Boisselle & Sklar, LLP

(57) ABSTRACT

A method for depositing a zinc-nickel alloy on a substrate, including:

(a) providing the substrate, (b) providing an aqueous zinc-nickel deposition bath as catholyte in a compartment, wherein the compartment includes an anode and anolyte, the anolyte being separated from catholyte by a membrane, and the catholyte includes nickel ions, complexing agent, zinc ions, (c) depositing zinc-nickel alloy onto the substrate, wherein after step (c) nickel ions have lower concentration than before step (c), (d) rinsing the zinc-nickel coated substrate in water, obtaining a rinsed zinc-nickel coated substrate and rinse water including a portion of the complexing agent and nickel ions, wherein (i) a portion of rinse water and/or a portion of catholyte is treated in a first treatment compartment to separate water from the complexing agent and the nickel ions, (Continued)

(ii) returning the separated complexing agent to the catholyte, and
(iii) adding nickel ion to the catholyte.

13 Claims, 1 Drawing Sheet

(51) Int. Cl.
*C25D 5/34* (2006.01)
*C25D 21/16* (2006.01)
*C25D 21/18* (2006.01)
*C25D 21/20* (2006.01)

(58) Field of Classification Search
USPC ..... 205/99, 100, 101, 246, 98, 255
See application file for complete search history.

(56) References Cited

U.S. PATENT DOCUMENTS

| | | | | |
|---|---|---|---|---|
| 2011/0031127 | A1 | 2/2011 | Hillebrand | |
| 2013/0264215 | A1 | 10/2013 | Weyhmueller et al. | |
| 2016/0024683 | A1 * | 1/2016 | Dingwerth | C25D 17/002 205/244 |

FOREIGN PATENT DOCUMENTS

| | | | | |
|---|---|---|---|---|
| EP | 1369505 | A2 | 12/2003 | |
| EP | 1533399 | A2 * | 5/2005 | B01D 61/44 |
| EP | 1533399 | A2 | 5/2005 | |

* cited by examiner

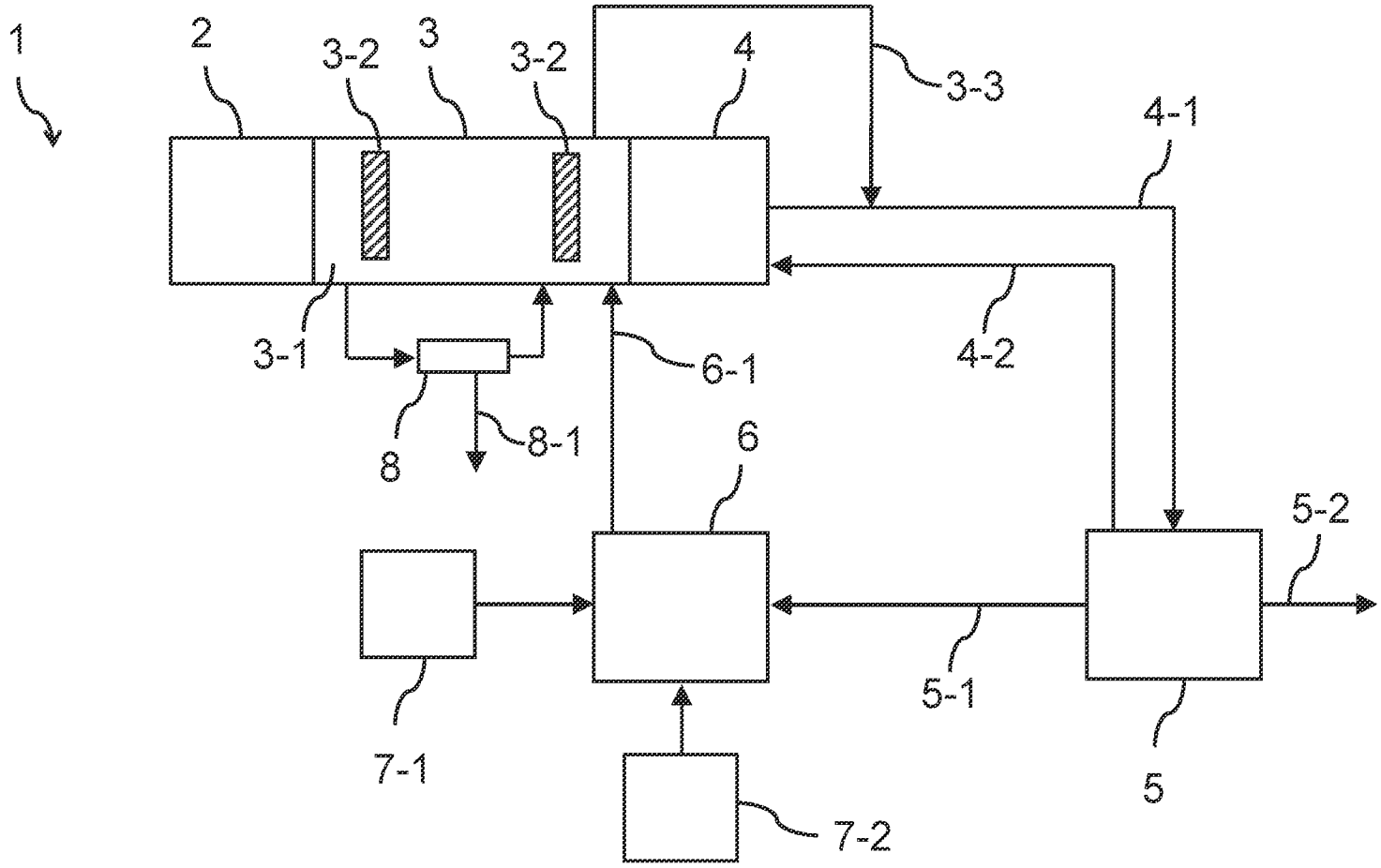
1
2
3
3-1
3-2
3-2
3-3
4
4-1
4-2
5
5-1
5-2
6
6-1
7-1
7-2
8
8-1

METHOD AND SYSTEM FOR DEPOSITING A ZINC-NICKEL ALLOY ON A SUBSTRATE

This application is a national phase of International Application No. PCT/EP2020/086976 filed 18 Dec. 2020, which claims priority to European Patent Application No. 19218655.9 filed 20 Dec. 2019, each of which is hereby incorporated herein by reference in its entirety.

FIELD OF THE INVENTION

The present invention according to a first aspect relates to a method for depositing a zinc-nickel alloy on a substrate, in particular to a method for electrolytically depositing a zinc-nickel alloy on a substrate.

According to a second aspect the present invention is further directed to a system for depositing a zinc-nickel alloy on a substrate, in particular to a system for electrolytically depositing a zinc-nickel alloy on a substrate.

BACKGROUND OF THE INVENTION

The electrolytic deposition of a metal alloy, sometimes also referred to as a coating, on other metals or metal-coated plastics, typically referred to as substrates, is a well established technique in order to increase the corrosion resistance of such substrates. The deposition is usually carried out using anodes and the substrate being the cathode upon applying an electrical current in a respective electrolyte.

In some cases, it is beneficial to separate the electrolyte by means of a semipermeable membrane into a catholyte compartment comprising a catholyte, which is the electrolyte in the cathode space, and an anolyte compartment comprising an anolyte, which is an electrolyte in the anode space. Often the anolyte is different from the catholyte. By applying an electric potential, a current flows via the anolyte through the membrane to the catholyte to start the electrolytic deposition on the substrate.

US 2011/031127 A1, Hillebrand, discloses such an alkaline electroplating bath for plating zinc-nickel coatings, having an anode and a cathode, wherein the anode is separated from the alkaline electrolyte by an ion exchange membrane.

US 2013/0264215 A1, Umicore, discloses an anode system, which is configured in such a way that it is suitable for use in electroplating cells for the deposition of electrolytic coatings as a result of simple dipping into the catholyte, wherein, after dipping into the catholyte, the catholyte is separated from the anode by a swollen polymer membrane, which is permeable to cations or anions and the polymer membrane is in direct contact with the anode and not with the cathode, wherein the membrane is fixed onto the anode by means of electrolyte-permeable holders and pressing devices by means of a multiplayer structure, which ensures good contact of the membrane with the anode.

DE 20 2015 002 289 U1 discloses an electro-dialytic cell with an anion- and cation-exchange membrane for use as an anode in alkaline zinc- and zinc-alloy-electrolytes for electrodeposition in galvanic systems.

EP 1 533 399 A2 refers to a method for alkaline zinc nickel plating with reduced waste water.

Typically, zinc-nickel deposition baths are often used continuously for an extended period of time, for example for weeks or even months, to allow for an efficient deposition of zinc-nickel alloy on a plurality of different substrates. When using a zinc-nickel deposition bath for such an extended period of time, typically undesired compounds (in particular degradation products of organic compounds such as complexing agents including cyanides) start to accumulate over time in the zinc-nickel deposition bath. This often significantly impairs the deposition process after a certain time, and could ultimately lead to the necessity of at least partially replacing the zinc-nickel electrodeposition bath. In many cases this is prevented by constantly removing at least a part of the deposition bath (e.g. by drag out) as waste water.

However, since nickel ions and often cyanides are included, an intensive waste water treatment is required before waste water disposal. Therefore, there is an ongoing demand to further improve existing deposition methods, in particular in view of environmental aspects. Since statutory limits are tightened world-wide, in particular in view of nickel ions, a more sustainable method for depositing a zinc-nickel alloy on a substrate is urgently demanded, which provides less or no waste water or at least a lower contamination with critical metal ions. On the other hand, it is still required that such a method can be operated economically and does not compromise the so far known corrosion protection.

Objectives of the Present Invention

It was therefore the objective of the present invention to provide a very environmental friendly method and system for deposition a zinc-nickel alloy on a substrate, which does not produce waste water or at least minimizes the contamination with critical metal ions such as nickel ions and cyanide ions but at the same time can be economically operated over a long time.

SUMMARY OF THE INVENTION

The objective mentioned above is solved according to a first aspect by a method for depositing a zinc-nickel alloy on a substrate, the method comprising the steps:

(a) providing the substrate, (b) providing an aqueous zinc-nickel deposition bath as a catholyte in a deposition compartment, wherein
- the deposition compartment comprises at least one anode with an anolyte, and
- the anolyte is separated from the catholyte by at least one membrane, and
- the catholyte comprises
  - (i) nickel ions,
  - (ii) at least one complexing agent for nickel ions, and
  - (iii) zinc ions, (c) contacting the substrate with the catholyte in the deposition compartment such that the zinc-nickel alloy is electrolytically deposited onto the substrate and thereby obtaining a zinc-nickel coated substrate, wherein
- after step (c) the nickel ions in the catholyte have a lower concentration than before step (c), (d) rinsing the zinc-nickel coated substrate in a rinsing compartment comprising water, such that a rinsed zinc-nickel coated substrate and rinse water is obtained, wherein
- the rinse water comprises a portion of the at least one complexing agent for nickel ions and a portion of the nickel ions, characterized in that (i) at least a portion (preferably all) of the rinse water and/or at least a portion of the catholyte is treated in a first treatment compartment such that water is separated from the at least one complexing agent for nickel ions and the nickel ions, (ii) at least a portion (preferably all) of the at least one complexing agent separated from water is returned into the catholyte, and (iii) a nickel ion source is added to the catholyte, with the proviso that the nickel ion source does not comprise said at least one complexing agent for nickel ions or any other complexing agent for nickel ions.

The method of the present invention excellently solves the above defined objective, because it allows a closed-loop operation, theoretically over an unlimited time period, but at least over weeks and in particular over month. During that time, water is disposed substantially free of nickel and cyanide ions (therefore not called waste water).

During the closed-loop operation preferably only the nickel ions and zinc ions, which are deposited on the substrate during the depositing, must be replenished. All other compounds included in the deposition bath, preferably in the catholyte, are recycled.

By returning the at least one portion (preferably all) of the at least one complexing agent, which has been separated from water in the first treatment compartment, into the catholyte (either directly or indirectly), the concentration of the at least one complexing agent for nickel ions in the catholyte is maintained at a constant concentration. As defined in the method of the present invention, no or almost no complexing agent must be replenished. This is accomplished by utilizing the at least one anode with the at least one membrane. Such membranes prevent the anodic degradation of organic compounds, e.g. of the complexing agent. Complexing agent, dragged out into the rinsing compartment is recycled by means of the first treatment compartment. This allows that nickel ions are replenished free of any complexing agent.

In particular, it is sufficient to provide an initial concentration of the at least one complexing agent for nickel ions when setting up the aqueous zinc-nickel deposition bath, preferably the catholyte, wherein no additional complexing agent has to be added during the deposition method.

Moreover, when treating the rinse water in the first treatment compartment such that water is separated, typically very pure water is obtained, which can be used again.

The objective mentioned above is furthermore solved according to a second aspect by a system for depositing a zinc-nickel alloy on a substrate, the system comprising:

(I) optionally, a pre-rinsing compartment for pre-rinsing the substrate, (II) a deposition compartment for electrolytically depositing in a catholyte the zinc-nickel alloy on the substrate such that a zinc-nickel coated substrate is obtained, wherein the deposition compartment comprises at least one anode with at least one membrane, (III) a rinsing compartment for rinsing the zinc-nickel coated substrate such that a rinsed zinc-nickel coated substrate and rinse water is obtained, (IV) a first treatment compartment for treating the rinse water and a portion of the catholyte such that water is separated from nickel ions and complexing agents for nickel ions, and (V) optionally, a second treatment compartment for treating the catholyte such that dissolved anions are separated from the catholyte, wherein the first treatment compartment is adapted such that the separated water is returned into the pre-rinsing compartment and/or the rinsing compartment, and the separated nickel ions and the separated complexing agents for nickel ions are returned into the deposition compartment, preferably via a mixing compartment.

BRIEF DESCRIPTION OF THE FIGURE

In the FIGURE, a schematic representation of a system for depositing a zinc-nickel alloy on a substrate is shown, preferably for carrying out the method of the present invention. The system comprises various compartments. Most of them are fluidically connected with each other. Further details are given in the "Examples" section below in the text.

DETAILED DESCRIPTION OF THE INVENTION

In the context of the present invention, the term "at least one", "one or more than one", and or "one or more" denotes (and is exchangeable with) "one, two, three or more than three".

In the context of the present invention, anolyte typically is an electrolyte being in direct contact with the at least on anode, wherein catholyte is an electrolyte or at least part of an electrolyte being in contact with the cathode, i.e. the substrate, at least for the time the catholyte is located in a deposition compartment.

As already mentioned above, a major advantage, which is achieved by the method of the present invention, is that degradation products are not formed due to anodes with the at least one membrane. This preferably means that the at least one anode and the at least one membrane are adapted to form the anolyte, which is separated from the catholyte, and a selective permeation of ions between catholyte and anolyte is only possible through the at least one membrane. The at least one membrane is adapted to not allow the at least one complexing agent to pass through said membrane (from the catholyte into the anolyte). This allows said closed-loop operation, which constantly recycles the initial concentration of the at least one complexing agent for nickel ions. Most preferably, the at least one membrane allows only permeation of hydrogen ions (formed in the anolyte) into the catholyte.

Thus, a method of the present invention is preferred, wherein the at least one complexing agent for nickel ions is not in contact with the at least one anode, most preferably is not in contact with any of the at least one anodes.

Furthermore, a method of the present invention is preferred, wherein the catholyte comprises only an initial concentration of the at least one complexing agent for nickel ions for at least one nickel ion turn over, more preferably for at least 2 nickel ion turn overs, even more preferably for at least 3 nickel ion turn overs, most preferably for the entire life time of the catholyte.

Said at least one membrane preferably allows only for a diffusion of protons between the anolyte and catholyte, which ensures an efficient distribution of charges between the anolyte and the catholyte.

During the method of the present invention, water is typically introduced into the catholyte, e.g. by means of the nickel ion source for replenishing nickel ions. However, in the first treatment compartment excessive water is separated and subsequently removed from the method of the present invention such that a basically constant volume of the catholyte is maintained over time. If such excessive water cannot be used in the method of the present invention, it is preferably easily disposed because it is substantially free of nickel ions and preferably of also zinc ions; substantially no complexing agent is present.

Summarizing, the method of the present invention allows for an economic, sustainable, continuous operation over an extended period of time, i.e. for several weeks or even several months. During the extended period of time no nickel contaminated waste water is produced and no valuable metal ions as well as complexing agent is lost due to drag out. Basically, only the amount of deposited nickel and zinc ions has to be replenished by a respective nickel and zinc ion source.

Regarding the method of the present invention, most preferably at least a portion of the rinse water (preferably all) and at least a portion of the catholyte is treated in the first treatment compartment such that water is separated from the at least one complexing agent for nickel ions and the nickel ions. Treating also a portion of the catholyte (in addition to the rinse water, preferably in addition to all of the rinse water) allows to maintain a basically constant volume of the catholyte.

By separating the at least one complexing agent for nickel ions and the nickel ions from water, the so recycled complexing agent and nickel ions have a desired concentration before returning them into the catholyte.

A method of the present invention is preferred, wherein the complexing agent separated from water is returned into the catholyte as a concentrated aqueous solution. More preferably, the complexing agent separated from water is directly or indirectly returned into the catholyte as a concentrated aqueous solution, most preferably the complexing agent separated from water is indirectly returned into the catholyte as a concentrated aqueous solution via the mixing unit.

The mixing unit is preferably used to mix the separated complexing agent with e.g. the nickel ion source and/or a zinc ion source, most preferably the mixing unit provides a freshly mixed aqueous zinc-nickel deposition bath ready for transfer into the deposition compartment in order to supplement the catholyte.

By returning complexing agent and thereby maintaining a basically constant concentration of complexing agent, a continuously constant stabilization of nickel ions is achieved in the catholyte, which in turn provides a good stability of the catholyte. When the complexing agent is returned indirectly to the catholyte via the mixing unit, the complexing agent is preferably used to complex freshly introduced nickel ions from the nickel ion source into the mixing unit (see FIG. 1).

Thus preferred is a method of the present invention, wherein the nickel ion source is added directly or indirectly to the catholyte, preferably indirectly via a mixing unit (preferably as described above).

Preferred is a method of the present invention, wherein a zinc ion source is added directly or indirectly to the catholyte, preferably indirectly via a mixing unit (preferably as described above). More preferably, zinc ions are obtained by dissolving metallic zinc in sodium hydroxide to obtain zinc hydroxo complexes, which allows for an efficient stabilization of the zinc ions in the catholyte.

By adding the nickel and zinc ion source to the catholyte, nickel and zinc ions are replenished. Preferably, the nickel and zinc ion source is added indirectly via the mixing unit such that a thoroughly mixed composition is prepared before transferring it to the deposition compartment.

A method of the present invention is preferred, wherein the anolyte is water, preferably water comprising sulfuric acid, most preferably water comprising 5 vol.-% to 40 vol.-% sulfuric acid.

A method of the present invention is preferred, wherein the catholyte comprises more than 50 vol.-% water, based on the total volume of the catholyte, more preferably comprises 75 vol.-% or more water, even more preferably comprises 85 vol.-% or more water, most preferably comprises 92 vol.-% or more water. Preferably, water is the only solvent in the catholyte.

A method of the present invention is preferred, wherein the nickel ion source is an aqueous solution comprising water and a nickel salt dissolved therein. A method of the present invention is preferred, wherein the nickel salt is an inorganic salt. This preferably means that the nickel salt does not comprise a carboxylic acid anion, more preferably does not comprise an organic acid anion, most preferably does not comprise an organic anion.

By excluding organic anions, in particular carboxylic anions, the accumulation of potentially disadvantageous organic anions in the catholyte over time can be prevented. Furthermore, potential complexing agents for nickel ions are thereby basically excluded.

A method of the present invention is preferred, wherein the nickel salt comprises nickel sulfate, preferably nickel sulfate hexahydrate.

A method of the present invention is preferred, wherein the nickel salt does not comprise nickel chloride. By excluding nickel chloride, the concentration of chloride ions in the catholyte can be minimized or most preferably even eliminated, thereby eliminating the necessity to remove excessive amounts of chloride from the catholyte during the method of the present invention (which in turn is typically difficult due to the high solubility of chloride salts).

A method of the present invention is preferred, wherein the nickel salt does not comprise nickel nitrate. By excluding nickel nitrate, the concentration of nitrate ions in the catholyte is prevented. In many cases nitrate is disturbing the entire electrolytic deposition and is highly undesired.

The nickel ion source is most preferably an aqueous solution comprising water and nickel sulfate, preferably nickel sulfate hexahydrate, dissolved therein. Such a preferred nickel ion source is excellently suitable for replenishing nickel ions. Regarding any accumulation of sulfate anions, see the text below.

A method of the present invention is preferred, wherein in the nickel ion source nickel ions have a concentration in a range from 70 g/L to 140 g/L, based on the total volume of the nickel ion source, preferably from 80 g/L to 120 g/L, more preferably from 90 g/L to 110 g/L, even more preferably from 95 g/L to 105 g/L.

As mentioned above, the nickel ion source does not comprise said at least one complexing agent for nickel ions or any other complexing agent for nickel ions.

This means that the at least one complexing agent for nickel ions is not replenished by means of the nickel ion source. Most preferably, the at least one complexing agent for nickel ions is not replenished at all. Furthermore, also a complexing agent different from the at least one complexing agent for nickel ions, e.g. the complexing agent used to initially set up the aqueous zinc-nickel deposition bath, is not added to the catholyte. Preferred is therefore a method of the present invention, wherein the catholyte comprises only one complexing agent for nickel ions (and thus not a mixture of two or more than two complexing agents). This is helpful in order to monitor the total amount of complexing agent in the catholyte over a long time.

A method of the present invention is preferred, wherein the nickel ion source is essentially free of or does not comprise tetraethylenepentamine, preferably is essentially free of or does not comprise a diamine, most preferably is essentially free of or does not comprise an amine. This is mostly preferred because such compounds are typically used as complexing agents for nickel ions in an aqueous zinc-nickel deposition bath (for further details about complexing agents see text below). In particular such compounds are therefore undesired in the nickel ion source in order to prevent their accumulation.

A method of the present invention is preferred, wherein the nickel ion source is essentially free of or does not comprise an amine having one or more than one, preferably two, primary amine group and one or more than one secondary amine group.

In the method of the present invention, the catholyte comprises at least one (preferably one) complexing agent for nickel ions.

A method of the present invention is preferred, wherein in the catholyte the at least one complexing agent for nickel ions comprises a chelating complexing agent, wherein preferably a chelating complexing agent is the only complexing agent for nickel ions in the catholyte. By using a chelating complexing agent, an efficient stabilization of the nickel ions in the catholyte is ensured. In particular, the at least one complexing agent has to be provided only once when initially setting up the aqueous zinc-nickel deposition bath, while no additional complexing agent has to be added afterwards.

A method of the present invention is preferred, wherein in the catholyte the at least one complexing agent for nickel ions comprises an amine, preferably a diamine, most preferably tetraethylenepentamine. The amine, diamine and tetraethylenepentamine, respectively, as complexing agent for nickel ions allows for an excellent stabilization of nickel ions in the catholyte, in particular at an alkaline pH.

A method of the present invention is preferred, wherein the amine, preferably the diamine, most preferably the tetraethylenepentamine, is the only complexing agent for nickel ions in the catholyte.

A method of the present invention is preferred, wherein the diamine is selected from the group consisting of ethylenediamine, diethylenetriamine, triethylenetetramine, and tetraethylenepentamine.

Generally, a method of the present invention is preferred, wherein in the catholyte the at least one complexing agent for nickel ions comprises an amine having one or more than one, preferably two, primary amine group and one or more than one secondary amine group.

A method of the present invention is preferred, wherein the amine having one or more than one, preferably two, primary amine group and one or more than one secondary amine group, is the only complexing agent for nickel ions in the catholyte.

A method of the present invention is preferred, wherein the nickel ions of the nickel ion source added to the catholyte are not complexed before being in contact with an alkaline environment, preferably an environment having a pH ranging from 10.0 to 14.0, more preferably from 11.0 to 13.3, even more preferably from 11.5 to 13.0, yet even more preferably from 12.0 to 12.9, most preferably from 12.3 to 12.8. In other words, the nickel ions of the nickel ion source added to the catholyte are preferably complexed for the first time when contacted with an alkaline environment, preferably an environment having a pH as defined above, which is most preferably the catholyte.

Furthermore, the present text refers to an alternative method for depositing a zinc-nickel alloy on a substrate, the method comprising the steps:

(a) providing the substrate, (b) providing an alkaline aqueous zinc-nickel deposition bath as a catholyte in a deposition compartment, wherein the deposition compartment comprises at least one anode with an anolyte, and the anolyte is separated from the catholyte by at least one membrane, and the catholyte comprises (i) nickel ions, (ii) at least one complexing agent for nickel ions, and (iii) zinc ions, (c) contacting the substrate with the catholyte in the deposition compartment such that the zinc-nickel alloy is electrolytically deposited onto the substrate and thereby obtaining a zinc-nickel coated substrate, wherein after step (c) the nickel ions in the catholyte have a lower concentration than before step (c), (d) rinsing the zinc-nickel coated substrate in a rinsing compartment comprising water, such that a rinsed zinc-nickel coated substrate and rinse water is obtained, wherein the rinse water comprises a portion of the at least one complexing agent for nickel ions and a portion of the nickel ions, characterized in that (i) at least a portion of the rinse water and/or at least a portion of the catholyte is treated in a first treatment compartment such that water is separated from the at least one complexing agent for nickel ions and the nickel ions, (ii) at least a portion of the at least one complexing agent separated from water is returned into the catholyte, and (iii) nickel ions are added to the catholyte from a nickel ion source to replenish nickel ions, wherein the nickel ions of the nickel ion source added to the catholyte are not complexed with a complexing agent before being in contact with an alkaline environment, preferably an environment having a pH ranging from 10.0 to 14.0, more preferably from 11.0 to 13.3, even more preferably from 11.5 to 13.0, yet even more preferably from 12.0 to 12.9, most preferably from 12.3 to 12.8.

The features of the method of the present invention as defined throughout the present text (including the preferred features etc.) are preferably also applicable to the alternative method (if technical applicable).

A method of the present invention is preferred, wherein step (a), prior to step (c), comprises step (a-1) pre-rinsing the substrate in a pre-rinsing compartment comprising water, such that a pre-rinsed substrate and pre-rinse water is obtained.

By pre-rinsing the substrate in the pre-rinsing compartment, potential contaminations on the substrate are removed before transferring the substrate into the deposition compartment. Preferably, the pre-rinsing compartment comprises an aqueous solution of sodium hydroxide as pre-rinsing solution.

In the method of the present invention, in step (d) the zinc-nickel coated substrate is rinsed in a rinsing compartment.

A method of the present invention is preferred, wherein the rinsing compartment comprises 2 to 5 fluidically connected rinsing sub-compartments forming a rinsing cascade.

Such rinsing cascade is particularly efficient in rinsing, since the concentration of ions rinsed out from the zinc-nickel coated substrate is effectively reduced step-wise, so that the most downstream rinsing sub-compartment comprises a significantly low concentration of ions compared to the most upstream rinsing sub-compartment of the rinsing cascade.

In the deposition compartment at least one anode and at least one membrane are present, wherein the at least one membrane separates the anolyte from the catholyte. Most preferably the at least one membrane is a semi-permeable membrane. This means that the at least one membrane is selectively permeable.

A method of the present invention is preferred, wherein the at least one membrane is a cation exchange membrane. By using a cation exchange membrane, any disadvantageous permeation of the at least one complexing agent from the catholyte into the anolyte is effectively prevented.

A method of the present invention is preferred, wherein in the deposition compartment the at least one anode is an insoluble anode, preferably an insoluble mixed metal oxide anode, most preferably an insoluble iridium/tantalum oxide on titanium anode.

A method of the present invention is preferred, wherein the at least one anode has a distance to the at least one membrane in a range from 0.5 mm to 5.0 mm, preferably from 0.75 mm to 4 mm, more preferably from 1.0 mm to 3.0 mm. This advantageously allows to keep the volume of the anolyte low, which in turn results in low amounts of waste water from the anolyte.

In the method of the present invention at least a portion of the rinse water and/or at least a portion of the catholyte is treated in a first treatment compartment such that water is separated from the at least one complexing agent for nickel ions and the nickel ions.

A method of the present invention is preferred, wherein the first treatment compartment comprises an evaporator, preferably a vacuum evaporator.

A method of the present invention is preferred, wherein in the evaporator a vacuum is applied in a range from 1 mbar to 100 mbar, preferably from 5 mbar to 70 mbar, more preferably from 10 mbar to 50 mbar, most preferably from 15 mbar to 35 mbar.

A method of the present invention is preferred, wherein in the first treatment compartment, preferably in the evaporator, most preferably in the vacuum evaporator, water is separated at a temperature in a range from 18° C. to 50° C., preferably from 23° C. to 46° C., more preferably from 28° C. to 42° C., most preferably from 31° C. to 40° C.

By using the evaporator, preferably the vacuum evaporator, an efficient evaporation of the water can be achieved, in particular by reducing the atmospheric pressure, thereby allowing an efficient separation of water from the nickel ions and from the at least one complexing agent. Since the boiling point of water is significantly lower than the boiling point of the at least one complexing agent, nickel and/or zinc ions, an efficient separation of water is achieved.

By operating the vacuum evaporator at a temperature between 18° C. and 50° C., an undesired heating or even thermal degradation of the at least one complexing agent is prevented.

A method of the present invention is preferred, wherein the vacuum evaporator is operated and controlled based on density measurement of the concentrated aqueous solution, preferably the density of the concentrated aqueous solution is in a range from 1.08 kg/L to 1.30 kg/L, based on the total volume of the concentrated aqueous solution, preferably more from 1.10 kg/L to 1.26 kg/L, more preferably from 1.15 kg/L to 1.24 kg/L, most preferably from 1.20 kg/L to 1.23 kg/L. A control based on density measurement is excellently suited to operate the first treatment compartment, preferably the evaporator, most preferably the vacuum evaporator, automatically. The above mentioned density ranges are most preferred. However, in some case a higher maximum density is acceptable as long as the concentrated aqueous solution does not form a phase separation. This possibly incudes maximum densities of e.g. 1.28 kg/L, 1.30 kg/L, in some cases even 1.32 kg/L. A phase separation also typically depends on the total amount of e.g. sulfate, carbonate, and hydroxides (e.g. sodium and/or potassium), which vary over time.

As defined above, the concentrated aqueous solution is aqueous. Thus, a method of the present invention is preferred, wherein the concentrated aqueous solution is homogeneous. This preferably means that the concentrated aqueous solution forms only a single phase; in other words the concentrated aqueous solution preferably does not form a phase separation. Most preferably the concentrated aqueous solution does not comprise an organic phase separated from an aqueous phase.

Thus, even more preferred is a method of the present invention, wherein the concentrated aqueous solution is completely aqueous.

By not exceeding the above mentioned maximum density of most preferably 1.26 kg/L (or even higher as mentioned above), a phase separation is preferably avoided.

As a result of the treatment in the first treatment compartment, very pure water and the concentrated aqueous solution is obtained.

A method of the present invention is preferred, wherein at least a portion of the separated water obtained in the first treatment compartment is returned into the pre-rinsing compartment and/or the rinsing compartment. Preferably, at least a portion of the separated water obtained in the first treatment compartment is returned into the rinsing compartment, more preferably into a rinsing sub-compartment of the rinsing cascade.

By returning separated water, which is very pure, water is recycled and waste water is avoided because the separated water is substantially free of complexing agent, nickel ions and zinc ions. It is therefore well suited to be used again in the pre-rinsing and rinsing compartment. By means of such a loop, no fresh water is preferably needed for the rinsing over a comparatively long time.

A method of the present invention is preferred, wherein water is separated from the at least one complexing agent for nickel ions and the nickel ions in such a way that in the deposition compartment the catholyte has a substantially constant volume, preferably has a constant volume. This is in particular achieved if in the first treatment compartment, besides the rinse water, additionally at least a portion of the catholyte is treated. Typically, more water is introduced into the catholyte (e.g. by adding the nickel ion source and formed in the catholyte by anodically formed hydrogen ions) than separated from the rinse water.

A method of the present invention is preferred, wherein at least a portion (preferably all) of the at least one complexing agent separated from water and at least a portion (preferably all) of the nickel ions separated from water are returned into the catholyte, preferably returned into the catholyte as a concentrated aqueous solution (preferably as described throughout the text). Preferably, the concentrated aqueous solution is returned directly or indirectly, preferably indirectly via the mixing unit.

Typically, the rinse water also comprises zinc ions. Thus, a method of the present invention is preferred, wherein the rinse water comprises a portion of the zinc ions.

A method of the present invention is preferred, wherein in the first treatment compartment water is separated from nickel ions, the at least one complexing agent for nickel ions, and zinc ions.

A method of the present invention is preferred, wherein nickel ions, zinc ions, and the at least one complexing agent for nickel ions are together returned into the catholyte, preferably as a concentrated aqueous solution (preferably as described throughout the text).

As mentioned above, a preferred nickel ions source comprises nickel sulfate. This means that sulfate anions are introduced into the catholyte, which typically accumulate over time. Furthermore, the catholyte typically has the tendency to form and accumulate carbonate anions. Both anions are usually well soluble in the catholyte. Although a certain concentration can be tolerated, over-accumulation of such anions is to be prevented. Thus, a method of the present invention is preferred, wherein said method comprises step (e) treating at least a portion of the catholyte in a second treatment compartment such that dissolved anions are separated from the catholyte, preferably by precipitation and/or ion exchange, most preferably by precipitation.

A method of the present invention is preferred, wherein the dissolved anions comprise sulfate, carbonate and/or chloride, preferably at least sulfate and carbonate.

By applying step (e) in addition to steps (a) to (d) the concentration of dissolved anions in the catholyte is significantly reduced and over-accumulation is avoided. As a result, the method of the present invention can be operated for extremely long time. Preferably, step (e) is applied when the dissolved anions have reached an undesired concentration, either individually or in total. Preferably, step (e) comprises a precipitation to remove one or more than one of such anions from the catholyte, most preferably by reducing the temperature of the at least a portion of the catholyte in the second treatment compartment and thereby lowering the solubility of respective salts.

Thus, preferably, sulfate and carbonate anions are separated from the catholyte by precipitated sulfate-anion and carbonate-anion comprising salts.

Most preferably, the treating in step (e) forms a solid precipitate. If the solid precipitate co-precipitates further catholyte ingredients, then a replenishment thereof is recommended (e.g. the at least one complexing agent for nickel ions). In some cases, such a co-precipitation appears unavoidable.

A method of the present invention is less preferred, wherein in the second treatment compartment the dissolved anions are separated by ion exchange. Typically, ion exchange is insufficiently specific for said dissolved anions.

A method of the present invention is preferred, wherein the precipitation is carried out at a temperature in a range from −5° C. to 11.0° C., preferably in a range from 0.5° C. to 10.0° C., more preferably in a range from 1.0° C. to 8.0° C., even more preferably in a range from 1.5° C. to 6° C., most preferably in a range from 2.0° C. to 4.0° C. As mentioned above, by significantly reducing the temperature in the second treatment compartment a low soluble anion-comprising salts is typically formed, thereby at least partially removing said anions from the catholyte. Most preferably, the low soluble anion-comprising salts are sodium salts. An alternatively preferred temperature is ranging from −3° C. to 5° C., preferably −2.5° C. to 4° C., most preferably −2° C. to 3° C.

Thus, a method of the present invention is preferred, wherein the dissolved anions comprise at least sulfate anions, and wherein sulfate anions are preferably separated by precipitated sodium sulfate.

Furthermore, a method of the present invention is preferred, wherein the dissolved anions comprise at least sulfate anions and carbonate anions, and wherein sulfate anions and carbonate anions are preferably separated by precipitated sodium sulfate and sodium carbonate, respectively.

Sodium salts are in particular preferred because sodium hydroxide is preferably used in order to maintain the pH of the catholyte. Since hydrogen ions are constantly anodically formed (resulting in chemically formed water), hydroxide is to be replenished constantly, which also introduces significant amounts of sodium. Thus, sodium is removed by the treatment in the second treatment compartment.

A method of the present invention is preferred, wherein the catholyte is alkaline, preferably having a pH in a range from 10.0 to 14.0, more preferably from 11.0 to 13.3, even more preferably from 11.5 to 13.0, yet even more preferably from 12.0 to 12.9, most preferably from 12.3 to 12.8.

As mentioned above, formation of degradation products in the catholyte is basically avoided due to the at least one anode and at least one membrane, separating the anolyte from the catholyte. This includes that undesired cyanides are basically not formed in the catholyte. Thus, a method of the present invention is preferred, wherein the catholyte comprises cyanide ions in a range from 0 mg/L to 2.5 mg/L, based on the total volume of the catholyte, preferably from 0 mg/L to 1.5 mg/L, more preferably from 0 mg/L to 1 mg/L, most preferably from 0 mg/L to 0.5 mg/L. Most preferably the catholyte is essentially free of cyanide ions, i.e. 0.001 mg/L to 0.05 mg/L; even most preferably does not comprise cyanide ions.

A method of the present invention is preferred, wherein the catholyte comprises oxalate ions in a range from 0 mg/L to 2.5 mg/L, based on the total volume of the catholyte, preferably from 0 mg/L to 1.5 mg/L, more preferably from 0 mg/L to 1 mg/L, most preferably from 0 mg/L to 0.5 mg/L. Most preferably the catholyte is essentially free of oxalate ions, i.e. 0.001 mg/L to 0.05 mg/L; even most preferably does not comprise oxalate ions. Also oxalate ions are typical degradation products, which are basically avoided in the method of the present invention.

Since neither cyanide ions nor oxalate ions are formed in the catholyte, no specific waste water treatment is necessary to address such ions.

As mentioned above, the zinc ions in the catholyte are replenished by means of a zinc ion source. A method of the present invention is preferred, wherein in the catholyte the zinc ions are present as hydroxo complexes. Preferably, the zinc ion source comprises water, hydroxide ions (preferably sodium hydroxide) and metallic zinc. Said hydroxo complexes are preferably obtained if metallic zinc is dissolved under alkaline conditions.

A method of the present invention is preferred, wherein in the catholyte the zinc ions do not form a complex with the at least one complexing agent for nickel ions, preferably do not form a complex with a diamine, more preferably do not form a complex with an organic complexing agent. Most preferably, the zinc ions in the catholyte are strongly stable as hydroxo complexes such that no complex formation of zinc ions with the at least one complexing agent for nickel ions is observed under alkaline conditions.

A method of the present invention is preferred, wherein in the catholyte the zinc ions have a concentration below 10 g/L, preferably in a range from 5.0 g/L to 9.0 g/L, more preferably from 5.2 g/L to 8.5 g/L, even more preferably from 5.4 g/L to 8.0 g/L, yet even more preferably from 5.7 g/L to 7.5 g/L, most preferably from 5.9 g/L to 7.3 g/L.

A method of the present invention is preferred, wherein in the catholyte the nickel ions have a concentration below 2.0 g/L, preferably in a range from 0.5 g/L to 1.9 g/L, more preferably from 0.6 g/L to 1.7 g/L, even more preferably from 0.7 g/L to 1.6 g/L, yet even more preferably from 0.8 g/L to 1.5 g/L, most preferably from 0.9 g/L to 1.4 g/L.

Advantageously, in the method of the present invention the above defined concentrations for nickel and zinc ions are typically below concentrations common in methods know in the art. Since nickel ions and preferably zinc ions are recycled in the method of the present invention, no significant amounts of nickel and zinc ions, respectively, are wasted.

As already mentioned above, excessive water (which is very pure) is separated and removed from the method of the present invention.

A method of the present invention is preferred, wherein at least a portion of the separated water obtained in the first treatment compartment is disposed, wherein the disposed water comprises nickel ions in a concentration range from 0 mg/L to 1.0 mg/L, based on the total volume of the disposed water, preferably 0 mg/L to 0.5 mg/L, even more preferably 0.01 mg/L to 0.11 mg/L, and most preferably 0.01 mg/L to 0.1 mg/L.

A method of the present invention is preferred, wherein at least a portion of the separated water obtained in the first treatment compartment is disposed, wherein the disposed water comprises zinc ions in a concentration range from 0 mg/L to 1.0 mg/L, based on the total volume of the disposed water, preferably 0 mg/L to 0.5 mg/L, more preferably 0.01 mg/L to 0.11 mg/L, and most preferably 0.01 mg/L to 0.1 mg/L.

Preferably, only a pH adaptation is required before the excessive water is disposed.

In other cases, it is very preferred to use the discarded water (preferably the excessive water) for pre-rinsing, i.e. in a rinsing step carried out prior to steps (b) and (c). This preferably means to discard (or dispose) this water into a pre-rinse compartment. This is most preferred. In this case no water is wasted but used to the best possible extent.

Also preferred is a method of the present invention, wherein the discarded water (preferably the excessive water) is used in further pre-treatment steps prior to steps (b) and (c), more preferably in cleaning steps, most preferably in one or more than one degreasing step (e.g. a soak cleaning step, an electro-cleaning step, etc.).

Also preferred is a method of the present invention, wherein the discarded water (preferably the excessive water) is used in one or more than one further post-treatment step, preferably in a passivation step for passivating the zinc-nickel coated substrate.

By utilizing the excessive water in one or more than one of the aforementioned applications, water is optimally used and waste water reduced to the best extent possible.

The present invention according to the second aspect provides a system for depositing a zinc-nickel alloy on a substrate, the system comprising:

(I) optionally, a pre-rinsing compartment for pre-rinsing the substrate, (II) a deposition compartment for electrolytically depositing in a catholyte the zinc-nickel alloy on the substrate such that a zinc-nickel coated substrate is obtained, wherein the deposition compartment comprises at least one anode with at least one membrane, (III) a rinsing compartment for rinsing the zinc-nickel coated substrate such that a rinsed zinc-nickel coated substrate and rinse water is obtained, (IV) a first treatment compartment for treating the rinse water and a portion of the catholyte such that water is separated from nickel ions and complexing agents for nickel ions, and (V) optionally, a second treatment compartment for treating the catholyte such that dissolved anions are separated from the catholyte, wherein the first treatment compartment is adapted such that the separated water is returned into the pre-rinsing compartment and/or the rinsing compartment, and the separated nickel ions and the separated complexing agents for nickel ions are returned into the deposition compartment, preferably via a mixing compartment.

Regarding (I), (II), (III), (IV), and (V) of the system of the present invention, the aforementioned regarding the method of the present invention preferably applies likewise. Thus, preferably, the aforementioned regarding the method of the present invention, preferably what is described as being preferred, applies likewise to the system of the present invention.

The present invention is described in more detail by the following non-limiting examples.

EXAMPLES

Test Plating Setup (According to the Invention)

In a test plating setup according to the invention, a zinc-nickel deposition bath is set up as a catholyte in a deposition compartment (appr. 20.000 L) in order to deposit a zinc-nickel alloy on small metal parts (e.g. screws; appr. 40 kg loading per barrel).

The catholyte initially comprises 0.9 g/L to 1.4 g/L nickel (II) ions, 5.9 g/L to 7.3 g/L zinc (II) ions, and a diamine with additionally at least one secondary amine group as chelating complexing agent for the nickel ions. The pH is strongly alkaline around 12.5 and is adjusted with sodium hydroxide.

A plurality of insoluble iridium/tantalum oxide on titanium anodes with cation exchange membranes is utilized. For each anode, the distance between the anode and the respective membrane is below 5 mm. Each anolyte, comprising water with sulfuric acid, is separated from the catholyte by said membranes such that the complexing agent is never in contact with the anodes.

The metal parts are contacted in the deposition compartment with the catholyte (approximately at 25° C.) and a current density of less than 1 A/dm$^2$ is applied for electrolytic deposition for varying times between 130 min to 170 min.

The test plating setup was utilized for 4 months and the consumption of water, chemical compounds, as well as the disposal of water was closely monitored.

During the 4 month process period, nickel ions are replenished with a nickel ion source, which is an aqueous solution comprising dissolved nickel sulfate without any complexing agent for nickel ions and having a nickel ion concentration of approximately 100 g/L. Zinc is replenished from metallic zinc dissolved under alkaline pH conditions.

No additional complexing agent for zinc ions is used due to the formation of zinc hydroxide complexes at the alkaline conditions.

After depositing the zinc-nickel alloy, the metal parts are rinsed with water in a rinsing compartment comprising five fluidically connected rinsing sub-compartments forming a 5-step rinsing cascade. Portions of the rinse water and portions of the catholyte are repeatedly combined and transferred into a vacuum evaporator (40° C., approximately 50 mbar, capacity: approximately 150 L/h) in order to separate water from the complexing agent, nickel ions, and zinc ions, respectively. A portion of the separated water is returned into the rinsing cascade. Excessive water (nickel and zinc concentration below 0.1 mg/L) is either for disposal or other industrial purposes, in particular for a pre-rinse step as used in this example. In each case, the separated water has a conductivity of less than 200 μS/cm. Nickel ions, zinc ions, and complexing agent are enriched as a concentrated aqueous solution (density between 1.20 kg/L to 1.23 kg/L; completely aqueous without any phase separation) and returned into the catholyte. During the approximately 4 month operating time approximately less than 500 L/week excessive water (<200 μS/cm) is disposed, preferably for pre-rinsing.

Even after the 4 month operation time, the catholyte does not comprise decomposition products such as cyanide and oxalate ions. This confirms that the complexing agent is neither decomposed in the deposition compartment nor in the vacuum evaporator. This is the basis for a repetitive use of the water.

After the approximately 4 month operation time a portion of the catholyte is treated in a second treatment compartment (freezing unit) at a temperature between 2° C. and 4° C. or between −2° C. and 2° C. in order to precipitate at least a portion of sulfate and carbonate anions. However, even after 4 month a critical concentration of carbonate and sulfate in the catholyte was not yet reached.

During the 4-month operation time, no complexing agent was added to the catholyte. Instead the concentration of the complexing agent in the catholyte remained constant with a variation of +/−2.5% due to measurement inaccuracies and varying volumes of the catholyte. Nickel and zinc ions are replenished in such a way that their concentration remained in the ranges as initially set up. Furthermore, no nickel contaminated water for disposal was produced.

In addition, the cathodic current efficiency (CCE) was approximately 15% to 30% higher than in a comparative test plating setup (see below).

Comparative Test Plating Setup (not According to the Invention):

In a comparative test plating setup (not according to the invention) a deposition bath is set up, which is basically identical to the catholyte used in the test plating setup according to the invention (also similar in terms of volume). However, the anodes are not separated by membranes. Thus, the complexing agent is at least partly decomposed at the anode and therefore must be replenished together with nickel ions. Although the rinse water (i.e. the waste water) is subjected to a vacuum evaporator to reduce the volume prior to waste water disposal, the waste water comprises significant amounts of decomposition products including cyanide. This requires a cost-intensive and professional disposal. The volume of the (concentrated) waste water amounted to approximately 1000 L/week, having a nickel concentration of at least 1 g/L, zinc of at least 8 g/l, cyanide of at least 0.1 g/L, and significant amounts of complexing agent. Thus, a significant amount of nickel and zinc is lost, which must be replenished to the deposition bath. Furthermore, complexing agent must be regularly added to the deposition bath.

In contrast, the method of the present invention (see example according to the invention) not only reduces the amount of water, which is to be disposed. The disposed water is additionally substantially free of nickel and zinc ions. Those ions, transferred through rinsing, are recycled back into the catholyte along with the complexing agent. As a result, the method of the present invention is a very environmental-friendly and cost-effective method and a strong improvement over existing methods.

System for Depositing a Zinc-Nickel Alloy on a Substrate (According to the Invention):

In the FIGURE, a schematic depiction of a system 1 for depositing a zinc-nickel alloy on a substrate is shown, wherein an aqueous zinc-nickel deposition bath is provided as a catholyte 3-1 in the deposition compartment 3.

The system 1 optionally comprises a pre-rinsing compartment 2 for pre-rinsing the substrate. Since the substrate to be coated is often contaminated with undesired contaminants, a pre-rinsing of the substrate in the pre-rinsing compartment 2 is generally recommended, e.g. with an alkaline pre-rinsing solution. However, if the substrate is already clean, a pre-rinsing is preferably omitted.

The system 1 further comprises the deposition compartment 3 for electrolytically depositing in the catholyte 3-1 the zinc-nickel alloy on the substrate. The catholyte provided in the deposition compartment comprises nickel ions, at least one complexing agent for nickel ions and zinc ions. In the deposition compartment 3 at least one anode with at least one membrane 3-2 is provided, which separates the catholyte from an anolyte. The volume of the anolyte is defined by the space formed by the at least one anode with the at least one membrane.

When the substrate, preferably the pre-rinsed substrate, is transferred into the catholyte 3-1 in the deposition compartment 3 and a current is applied, the zinc-nickel alloy is electrolytically deposited on the substrate, such that the zinc-nickel coated substrate is obtained.

The system 1 further comprises a rinsing compartment 4 for rinsing the zinc-nickel coated substrate such that a rinsed zinc-nickel coated substrate and rinse water is obtained. By rinsing the zinc-nickel coated substrate, leftovers of the catholyte are removed such that the obtained rinse water comprises a portion of the catholyte, which in turn comprises nickel ions, at least one complexing agent for nickel ions, and zinc ions.

The rinse water is transferred (preferably pumped) from the rinsing compartment 4 by rinse water line 4-1 to a first treatment compartment 5 of the system 1 for treating the rinse water. In addition, a portion of the catholyte is transferred (preferably pumped) from the deposition compartment 3 to the first treatment compartment 5 by catholyte removal line 3-3. The latter is needed to maintain a constant volume of the catholyte.

Treatment compartment 5 is preferably an evaporator, more preferably a vacuum evaporator, which allows for an efficient separation of water by evaporation.

At least a portion of the separated, preferably the evaporated, water is returned from the first treatment compartment 5 to rinsing compartment 4 by water return line 4-2. Furthermore, and optionally, another portion of the water is returned to the pre-rinsing compartment (not shown). Excessive water is disposed by water disposal line 5-2 and is preferably used for other industrial purposes since this water is very pure.

After separating water from nickel ions, from the at least one complexing agent for nickel ions, and zinc ions in the first treatment compartment 5, the separated nickel ions, the separated at least one complexing agent for nickel ions, and the separated zinc ions are returned into the deposition compartment 3 as a concentrated aqueous solution, either directly or as depicted in FIG. 1 preferably indirectly by transferring them from the first treatment compartment 5 to optional mixing unit 6 by separation line 5-1.

Optional mixing unit 6 is fluidically connected to nickel ion source 7-1, which preferably is an aqueous solution comprising water and nickel sulfate dissolved therein, and to zinc ion source 7-2, preferably as described above in the text for the method of the present invention. In mixing unit 6, replenished nickel ions and zinc ions are thoroughly mixed with the concentrated aqueous solution prior to returning them into the deposition compartment 3 by return line 6-1, thereby closing the loop. Thus, the nickel ions, the zinc ions, and the at least one complexing agent for nickel ions are maintained at a basically constant concentration in the catholyte.

The system 1 further comprises an optional second treatment compartment 8 for treating the catholyte 3-1 such that dissolved anions are separated from the catholyte 3-1, such as sulfate anions and carbonate anions. When operating the system for a long period of time, e.g. for several months, the concentration of dissolved anions, reaches an undesired limit such that at least partially such anions are removed in the second treatment compartment, preferably by precipitation. Such precipitated anions are removed by anion disposal line 8-1.

REFERENCE SIGNS

1 system for depositing a zinc-nickel alloy on a substrate
2 pre-rinsing compartment
3 deposition compartment
3-1 space for the catholyte
3-2 at least one anode with at least one membrane
3-3 catholyte removal line
4 rinsing compartment
4-1 rinse water line
4-2 water return line
5 first treatment compartment
5-1 separation line
5-2 water disposal line
5 mixing unit
6-1 return line
7-1 nickel ion source
7-2 zinc ion source
8 second treatment compartment
8-1 anion disposal line

The invention claimed is:

1. A method for depositing a zinc-nickel alloy on a substrate, the method comprising the steps:

(a) providing the substrate, (b) providing an aqueous zinc-nickel deposition bath as a catholyte in a deposition compartment, wherein the deposition compartment comprises at least one anode with an anolyte, and the anolyte is separated from the catholyte by at least one membrane, and the catholyte comprises:

(i) nickel ions, (ii) at least one complexing agent for nickel ions, and (iii) zinc ions, (c) contacting the substrate with the catholyte in the deposition compartment such that the zinc-nickel alloy is electrolytically deposited onto the substrate and thereby obtaining a zinc-nickel coated substrate, wherein after step (c) the nickel ions in the catholyte have a lower concentration than before step (c), (d) rinsing the zinc-nickel coated substrate in a rinsing compartment comprising water, such that a rinsed zinc-nickel coated substrate and rinse water is obtained, wherein the rinse water comprises a portion of the at least one complexing agent for nickel ions and a portion of the nickel ions, characterized in that:

(i) at least a portion of the rinse water and/or at least a portion of the catholyte is treated in a first treatment compartment such that the water is separated from the at least one complexing agent for nickel ions and the nickel ions, (ii) at least a portion of the at least one complexing agent separated from the water is returned into the catholyte as a concentrated aqueous solution, and (iii) a nickel ion source is added to the catholyte, with the proviso that the nickel ion source does not comprise said at least one complexing agent for nickel ions or any other complexing agent for nickel ions, wherein the nickel ion source is an aqueous solution comprising water and a nickel salt dissolved therein.

2. The method according to claim 1, wherein the at least one complexing agent for nickel ions is not in contact with the at least one anode.

3. The method according to claim 1, wherein the nickel ion source is essentially free of or does not comprise tetraethylenepentamine.

4. The method according to claim 1, wherein in the catholyte the at least one complexing agent for nickel ions comprises an amine.

5. The method according to claim 1, wherein step (a), prior to step (c), further comprises step (a-1) pre-rinsing the substrate in a pre-rinsing compartment comprising water, such that a pre-rinsed substrate and pre-rinse water is obtained.

6. The method according to claim 5, wherein at least a portion of the separated water obtained in the first treatment compartment is returned into the pre-rinsing compartment and/or the rinsing compartment.

7. The method according to claim 1, wherein the at least one anode has a distance to the at least one membrane in a range from 0.5 mm to 5.0 mm.

8. The method according to claim 1, wherein the first treatment compartment comprises an evaporator.

9. The method according to claim 1, further comprising step (e) treating at least a portion of the catholyte in a second treatment compartment such that dissolved anions are separated from the catholyte.

10. The method according to claim 9, wherein a precipitation is carried out at a temperature in a range from −5° C. to 11.0° C.

11. The method according to claim 9, wherein the dissolved anions comprise at least sulfate anions.

12. The method according to claim 1, wherein in the catholyte the zinc ions are present as hydroxo complexes.

13. The method according to claim 1, wherein at least a portion of the separated water obtained in the first treatment compartment is disposed, wherein the disposed water comprises nickel ions in a concentration range from 0 mg/L to 1.0 mg/L, based on the total volume of the disposed water.

* * * * *